US010955142B2

(12) United States Patent
Swayne et al.

(10) Patent No.: US 10,955,142 B2
(45) Date of Patent: Mar. 23, 2021

(54) COOKING OVEN WITH STEAM GENERATOR INSIDE COOKING CAVITY

(71) Applicant: Electrolux Home Products, Inc., Charlotte, NC (US)

(72) Inventors: Steven Swayne, Nashville, TN (US); Brendan McGinnis, Russellville, KY (US); Catherine L. May, Springfield, TN (US); Andrew Worley, Springfield, TN (US); Marco Carnevali, Forli (IT); Alberto Dell'Olio, Forli (IT); Paolo Faraldi, Forli (IT)

(73) Assignee: Electrolux Home Products, Inc., Charlotte, NC (US)

( * ) Notice: Subject to any disclaimer, the term of this patent is extended or adjusted under 35 U.S.C. 154(b) by 224 days.

(21) Appl. No.: 16/026,878

(22) Filed: Jul. 3, 2018

(65) Prior Publication Data

US 2020/0011536 A1 Jan. 9, 2020

(51) Int. Cl.

| | |
|---|---|
| ***F24C 7/06*** | (2006.01) |
| ***A21B 1/14*** | (2006.01) |
| ***A21B 1/24*** | (2006.01) |
| ***A47J 27/04*** | (2006.01) |
| ***F24C 15/00*** | (2006.01) |

(Continued)

(52) U.S. Cl.
CPC ..... *F24C 15/003* (2013.01); *F24C 13/00* (2013.01); *F24C 15/166* (2013.01)

(58) Field of Classification Search
CPC ..... F24C 15/322–327; F24C 7/06–067; F24C 7/08–082; F24C 7/085; F24C 7/087–088; A47J 27/04; A47J 2027/043; A21B 1/06–10; A21B 1/14–22; A21B 1/24–26; A21B 1/50
See application file for complete search history.

(56) References Cited

U.S. PATENT DOCUMENTS 867,660 A * 10/1907 Johnson ..... A47J 27/04 126/369
3,299,800 A * 1/1967 Angelo ..... A47J 37/06 99/417

(Continued)

FOREIGN PATENT DOCUMENTS

EP 1460342 9/2004
EP 2463590 A2 * 12/2011

(Continued)

OTHER PUBLICATIONS

International Search Report and Written Opinion for PCT/US2019/039157 dated Sep. 27, 2019, 13 pages.

*Primary Examiner* — Michael A Laflame, Jr.
(74) *Attorney, Agent, or Firm* — Pearne & Gordon LLP

(57) ABSTRACT

A cooking oven has a cooking cavity and a steam generating system. The steam generation system includes a water reservoir received and support in a reservoir-receiving space of a reservoir rack inside the cooking cavity. Thermal energy is provided to the water reservoir by a heater inside the cooking cavity. The heater can include thermal block made of a thermally conductive material in thermal communication with a heating element. The heater can be positioned such that it intimately contacts the water reservoir to deliver thermal energy thereto to convert water contained therein to steam, which can be used to cook a food item inside the cooking cavity.

18 Claims, 10 Drawing Sheets

(51) Int. Cl.
*F24C 13/00* (2006.01)
*F24C 15/16* (2006.01)

(56) References Cited

U.S. PATENT DOCUMENTS

| | | | | |
|---|---|---|---|---|
| 3,828,163 | A * | 8/1974 | Amagami | F24C 7/00 219/413 |
| 5,320,028 | A * | 6/1994 | Grunberg | A47J 36/18 126/369 |
| 5,515,773 | A | 5/1996 | Bullard | |
| 5,869,812 | A | 2/1999 | Creamer | |
| 6,202,637 | B1 * | 3/2001 | Roberts | A47J 27/10 126/20 |
| 6,833,534 | B2 | 12/2004 | Bellassai | |
| 6,972,397 | B2 | 12/2005 | Ha | |
| 7,045,745 | B2 | 5/2006 | Kim | |
| 7,326,891 | B2 | 2/2008 | Sung | |
| 7,326,893 | B2 | 2/2008 | Kanzaki | |
| 7,537,004 | B2 | 5/2009 | Reay | |
| 7,777,158 | B2 | 8/2010 | Saltenis | |
| 8,369,695 | B2 | 2/2013 | Lee | |
| 8,642,929 | B2 | 2/2014 | Saltenis | |
| 8,776,673 | B2 | 7/2014 | Cutler | |
| 9,127,849 | B2 | 9/2015 | Kang | |
| 2006/0096970 | A1 | 5/2006 | Yang | |
| 2007/0062927 | A1 | 3/2007 | Sells | |
| 2012/0055459 | A1 | 3/2012 | Ley | |
| 2016/0061490 | A1 * | 3/2016 | Cho | F24H 1/106 219/400 |
| 2016/0095469 | A1 | 4/2016 | Gregory et al. | |
| 2017/0343221 | A1 * | 11/2017 | Swayne | F24C 15/327 |

FOREIGN PATENT DOCUMENTS

| | | |
|---|---|---|
| EP | 3006832 | 4/2016 |
| EP | 3147573 | 3/2017 |
| EP | 3287700 | 2/2018 |
| JP | 2016013263 | 1/2016 |
| WO | 2009065197 | 5/2009 |
| WO | 2011163217 | 12/2011 |

* cited by examiner

COOKING OVEN WITH STEAM GENERATOR INSIDE COOKING CAVITY

BACKGROUND

Cooking ovens capable of steam cooking are known in the art. Existing steam ovens typically include a powered steam generator outside of the cooking cavity that delivers steam into the cooking cavity. This requires a system of pipes and valves to conduct the steam into the oven cavity. It would be desirable to generate steam directly in the oven cavity where it will be used.

SUMMARY

A cooking oven that includes a cooking cavity and a steam generation system is disclosed. The steam generation system includes a reservoir rack configured to support a water reservoir, a water reservoir configured to be supported by the reservoir rack, and a heater. The heater is arranged within the cooking cavity so that it is in conductive thermal communication with the water reservoir when the water reservoir is supported by the reservoir rack and the reservoir rack is in a cooking position within the oven cavity.

DETAIL DESCRIPTION OF PREFERRED EMBODIMENTS

Figure 1:
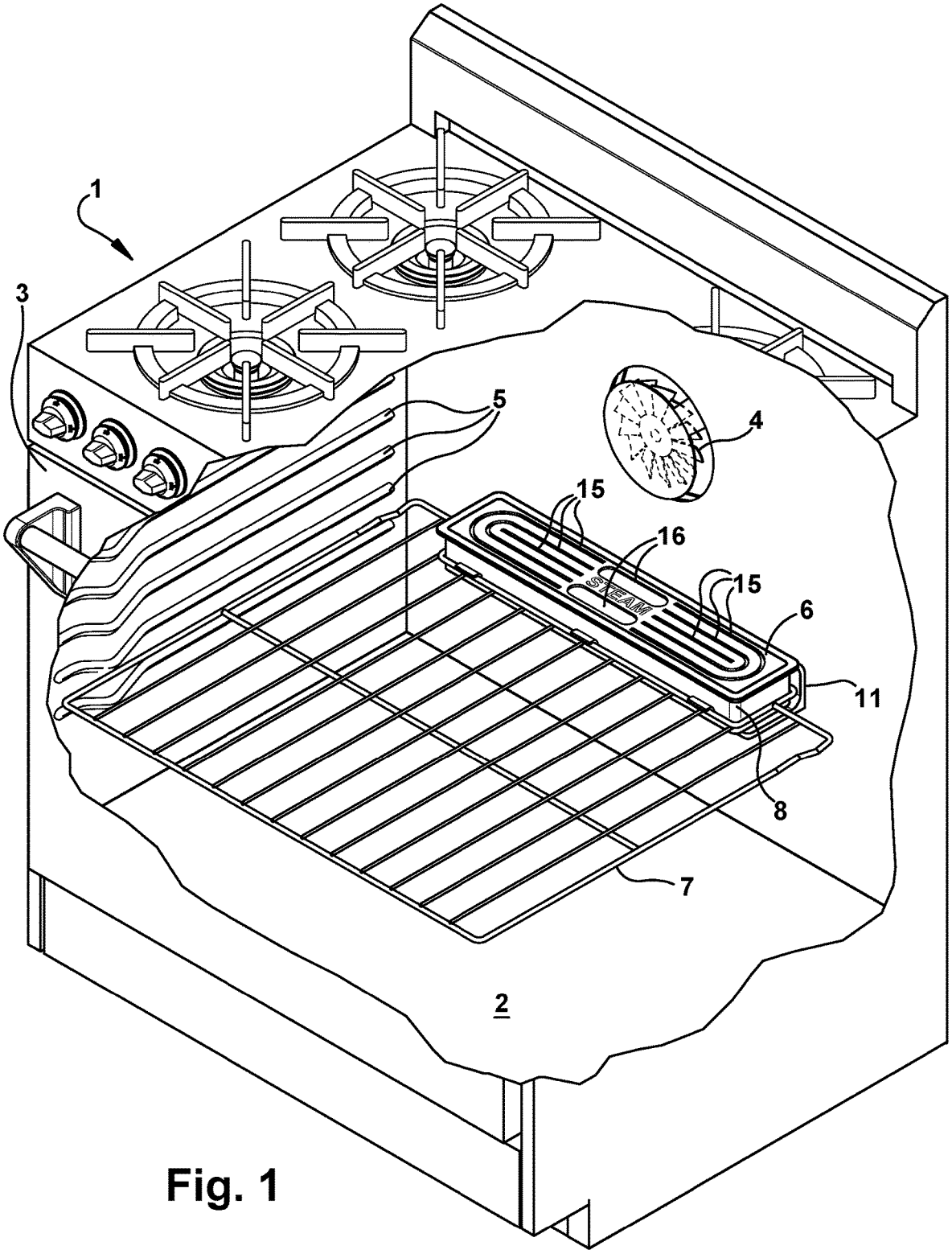
FIG. 1 is a schematic side cross-section of an oven having a steam generation system as described herein.

A cooking oven can include a cooking cavity accessible via an oven door and a steam generation system capable of generating steam for cooking food via steam cooking.

The steam generation system includes a water reservoir for holding water that can be heated into steam. The water reservoir has an inner volume for containing water and an opening that allows water to be filled into the inner volume and steam to escape into the cooking cavity. The water reservoir can be generally in the shape of a rectangular cuboid, including a bottom wall, side walls, and an open upper surface constituting the opening. The bottom wall and side walls define the inner volume that can contain water. Alternatively, the water reservoir can have a water filling section at a front end and a thermal contact section at the opposite, rear end connected by a sloped section for guiding waster from the water filling section to the thermal contact section via gravity. In some embodiments, the sloped bottom also serves as the water pouring section. For example, the water reservoir can have a general triangular prism shape with a sloped bottom wall section spanning the water pouring section and the thermal contact section.

In the disclosed embodiments, the water reservoir is configured such that it can be received and supported by a water-reservoir rack held by oven rack guides in the cooking cavity. The rack can be slid into and out of the cooking cavity supported by the rack guides like a conventional oven rack. Specifically, the reservoir rack is movable between a cooking position, where it is fully inserted in the cooking cavity, and a loading position, where it is fully withdrawn from the cooking cavity. The reservoir rack can also be removed from the cooking cavity so that it can be cleaned or the cooking cavity can be utilized in a way that the reservoir rack might otherwise impede.

Preferably, the water reservoir is configured such that is securely received and supported by the reservoir rack in use. For example, the water reservoir is preferably configured such that when received and supported by the reservoir rack, it is constrained in 5 of 6 directions (i.e. up, down, left, right, front, rear) of movement. As a result of this constriction, the water reservoir is preferably only able to be removed in the vertical direction. In this regard, the water reservoir does not move substantially with respect to the reservoir rack when the reservoir rack is slid into and out of the cooking oven. Because the water reservoir does not move substantially with respect to the reservoir rack, water spillage is reduced.

In a first embodiment the reservoir rack defines a water reservoir-receiving space that is designed to receive and support the water reservoir when in use within the cooking cavity. Preferably, the reservoir rack is designed as an otherwise conventional oven rack but for the receiving space. Thus, the reservoir rack can be in the form of a cooking grid made of metal bars arranged in a grid-like manner. A food item can be placed on the cooking grid to be cooked in the cooking cavity. The receiving space is preferably defined by the bars that form the rack to yield a shape that substantially corresponds to the shape of the water reservoir such that the reservoir can be received within the receiving space. The receiving space can be formed as a cutout in the grid of the reservoir rack. Alternatively, it can be located partially or fully outside that grid. The receiving space is preferably positioned in the reservoir rack such that it is adjacent the rear wall of the cooking cavity when the reservoir rack is fully inserted in the cooking position. In this regard, the cooking grid can receive a food item to be cooked without interfering with the water reservoir also supported on that rack. Thus, steam can emanate from the water reservoir to permeate the cooking cavity without being impeded by a cooking item on the reservoir rack. Moreover, the reservoir rack can be utilized in any manner as a conventional oven rack is utilized because the water reservoir-receiving space is largely out of the way at the rear of the rack.

The water reservoir preferably penetrates the receiving space in the water-reservoir rack when installed according to the present embodiment, such that it protrudes from an underside of that rack. For example, the water reservoir can be shaped such that its side walls are slanted to have a greater than 90° angle with the bottom wall such that the width of the water reservoir increases from the bottom wall to its opening at the top. The water reservoir can be inserted into the reservoir-receiving space until the perimeter of the reservoir matches the perimeter of the reservoir-receiving space such that the receiving space supports the reservoir. Alternatively, a perimeter flange can be attached or formed to the outer sides of the side walls of the water reservoir, or as a lip extending about the opening of the reservoir. The perimeter flange can engage the perimeter of the reservoir-receiving space such that the reservoir is supported thereby.

The water reservoir is preferably received and supported in the reservoir-receiving space such that when the reservoir rack is fully slid into the cooking oven, an outer surface of the water reservoir is in conductive thermal communication with a heater that is capable of generating thermal energy for converting water in the reservoir to steam. The thermal communication is preferably facilitated by intimate contact between an outer surface of the water reservoir and the heater. Preferably, the heater intimately contacts a lower portion of the water reservoir (i.e., a bottom outer wall surface or a bottom portion of an outer side wall surface). In this regard, as water is heated and converted to steam and the water volume in the reservoir decreases, liquid water remains in the vicinity of where the heater transmits thermal energy to the reservoir.

In another embodiment the water reservoir can include hooks that are used to suspend the reservoir from and beneath an oven rack. In this embodiment, the aforementioned hooks engage and are supported by bars or other structure of the oven rack in order to suspend the reservoir attached to the hooks. Such a water reservoir is preferably configured to have a water pouring section at a front end and a thermal contact section designed for contacting a heater at the opposite, rear end. The water pouring section and thermal contact section can be connected by a sloped section for guiding water from the water pouring section to the thermal contact section via gravity. In this configuration, the water reservoir can extend across most of the depth of the oven rack such that, when the water reservoir is suspended from an oven rack that is fully inserted within the oven cavity, the water pouring section is near the front and the thermal contact section is near the back for engaging the heater. Water can thus be poured into the water pouring section without the need to remove the reservoir or withdraw the rack, or to reach far into the oven cavity. In this embodiment additional water can be added to the water reservoir during use while minimizing risk of a user injury.

The heater can include a thermal block composed of thermally conductive material in thermal communication with (e.g. having embedded therein) an electric heating element. Alternatively, the heater can include an electric heating element without a thermal block. Preferably, the heating element is a resistance heating element such as a calrod element. The heating element typically includes heating element connectors at either end to establish a connection with a power source to supply power to the heating element. The heating element connectors can be plugged into sockets to complete an electrical heating circuit with the power source. Preferably those sockets are disposed in a rear wall of the cooking cavity, or they can be disposed behind the rear wall. In the latter embodiment, a portion of the heating element extends through openings in the rear wall of the cooking cavity in order to plug its connectors into the associated sockets behind that wall. These openings can be sealed to thermally insulate the cooking cavity and prevent fluids from passing through. Furthermore, the heating element is preferably wired in series with a thermal cut-off switch, or alternatively with a relay that is controlled based on temperature signals sensed by a temperature sensor. In this regard, when a certain temperature threshold is detected by the temperature sensor or is experienced by the thermal cut-off switch, the relay/switch can open the electrical circuit between the element and its power source to cease the generation of thermal energy.

When configured as a thermal block as described above, the heater is configured so that a wall of that block intimately contacts an outer surface of the water reservoir in use to efficiently deliver thermal energy to the reservoir when that reservoir is in reservoir-receiving space of the reservoir rack and the reservoir rack is in the cooking position. Preferably, the thermal block contacts a lower outer surface of the water reservoir. For example, the bottom outer surface of the reservoir can rest on the upper surface of the thermal block. Alternatively, a bottom portion of one or more outer side-wall surfaces of the water reservoir can contact the thermal block in use. Because the thermal block contacts the bottom or other lower surface of the water reservoir, it remains in close proximity to the remaining water throughout the process of steam generation. Among other advantages, this reduces heat loss in the generation of steam. The block is preferably located at the rear of the cooking cavity such that when the reservoir rack is in the cooking position, the water containing space aligns with the thermal block. When configured without a thermal block, the heater is configured so that the heating element itself intimately contacts an outer surface of the water reservoir in use to efficiently deliver thermal energy to the reservoir.

In order to reduce the likelihood that debris or other undesired material will fall into the water reservoir, the steam generation system can include a water-reservoir lid to close the opening of the water reservoir. The reservoir can have inner flanges extending from the inner side walls of the water reservoir for supporting the reservoir lid. Alternatively, the reservoir can close the opening of the reservoir by other conventional means. The reservoir lid itself has steam openings that allow steam produced in the water reservoir to escape into the cooking cavity. The size of the steam openings is preferably such that the steam produced in the water reservoir can easily escape but at the same time most debris produced inside a cooking cavity will not be small enough to fit through. The water reservoir can also have one or more larger openings constituting water filling ports so that the water reservoir can be filled without the need to remove the lid. These water filling ports are preferably large enough that water from common sources such as a faucet or a pitcher can flow through the ports easily. A user can add water to the reservoir through the water filling port in different ways. For example, a user can reach into the cooking cavity and pour water through the filling port using a pitcher. This can be done with the reservoir rack in the cooking position, the loading position, or anywhere in between. Additionally, the reservoir can be removed from the reservoir rack and filled outside of the cooking cavity, for example at a faucet.

The cooking oven can also include a convection fan preferably located at the rear wall of the cooking cavity above the water reservoir in order to circulate steam produced in the water reservoir. In addition to providing heat for the water reservoir, the heating element disclosed herein can also extend to the proximity of the convection fan in order to separately or additionally supply heat as part of a convection-cooking function.

Figure 2:
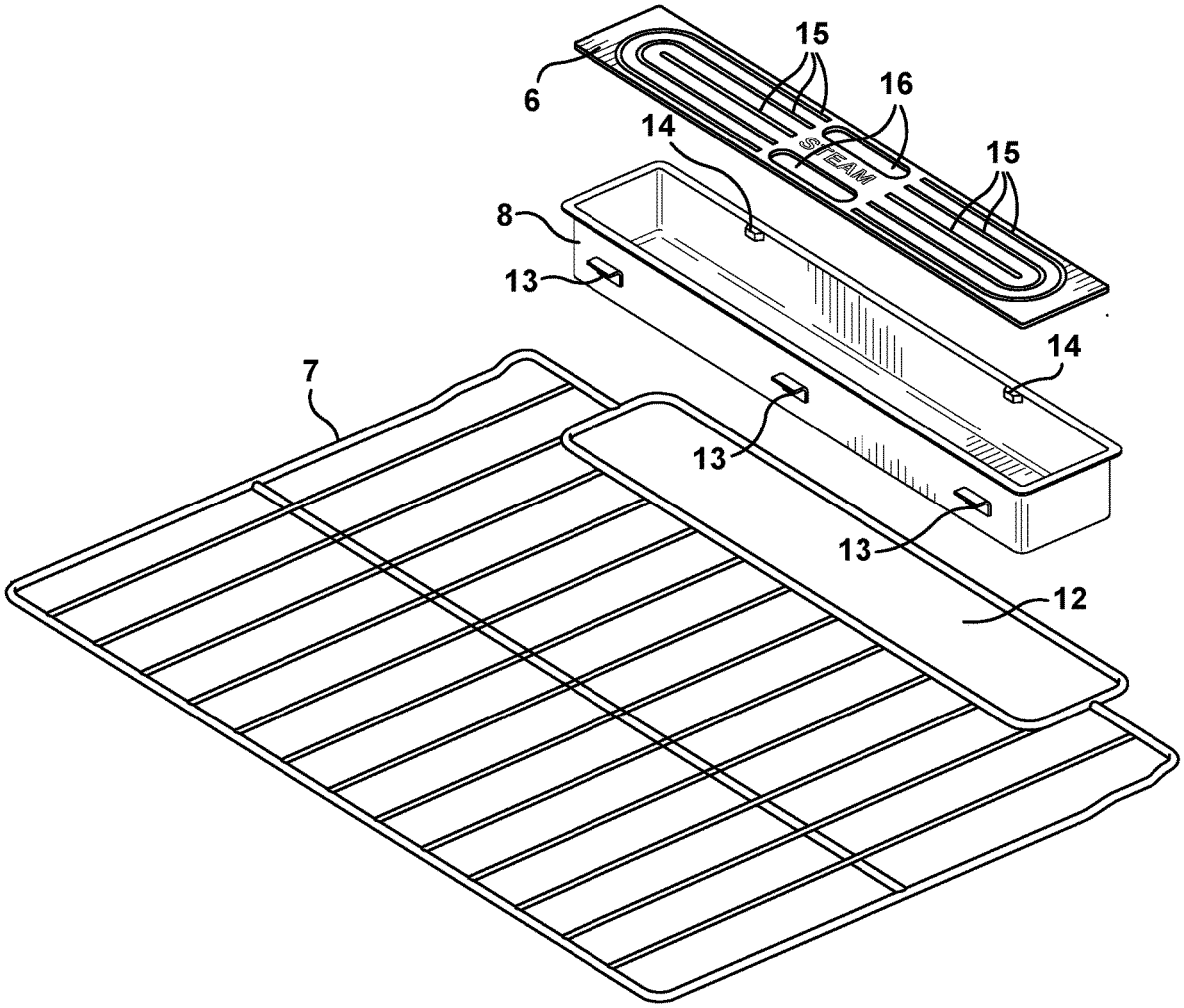
FIG. 2 is a front perspective view of an oven rack adapted to support a water reservoir for an embodiment of the steam generation system.
Figure 3:
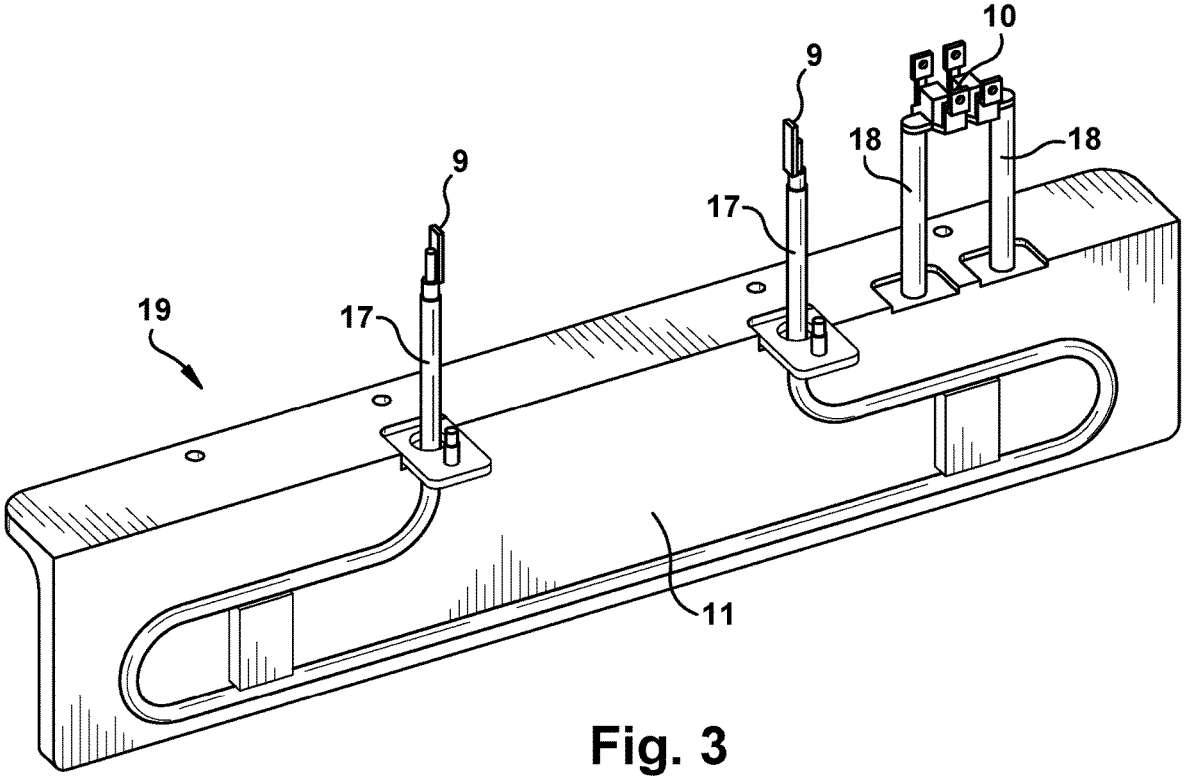
FIG. 3 is a rear perspective view of a thermal block of an embodiment of the steam generation system.
Figure 4:
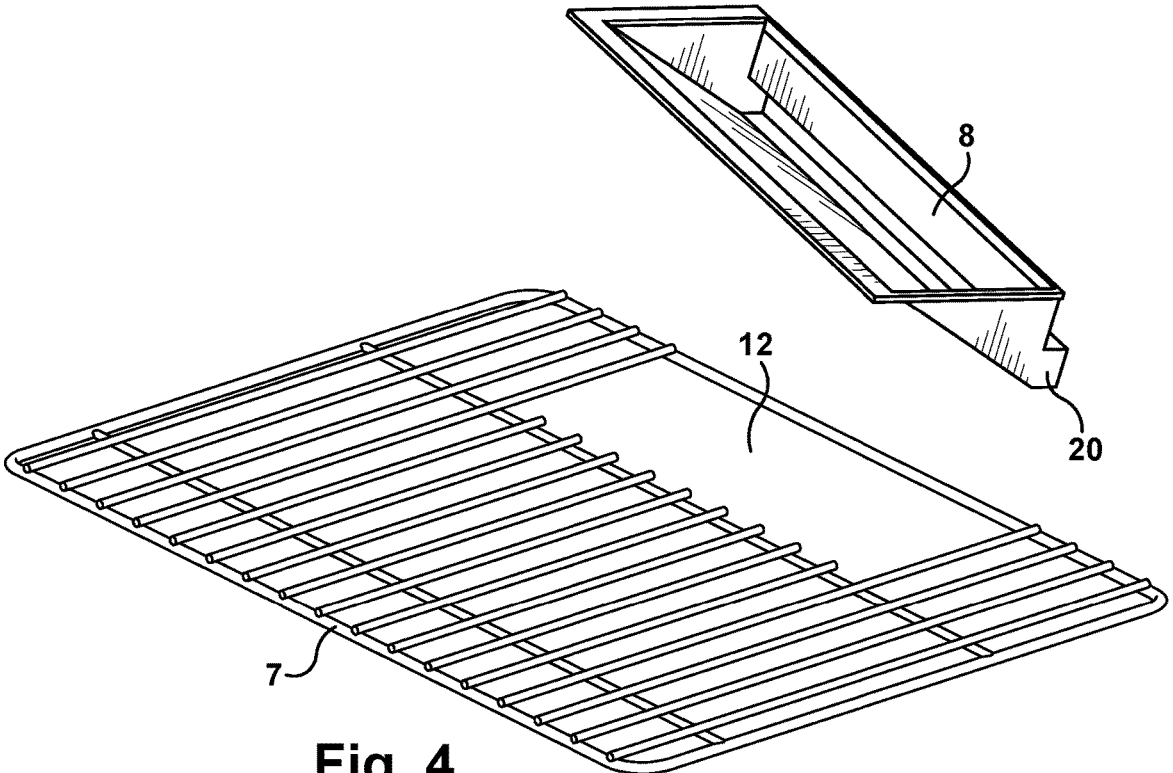
FIGS. 4-5 illustrate perspective views of a rack supporting a water reservoir according to another embodiment of the steam generation system, both removed from (FIG. 4) and installed in (FIG. 5) the rack.
Figure 5:
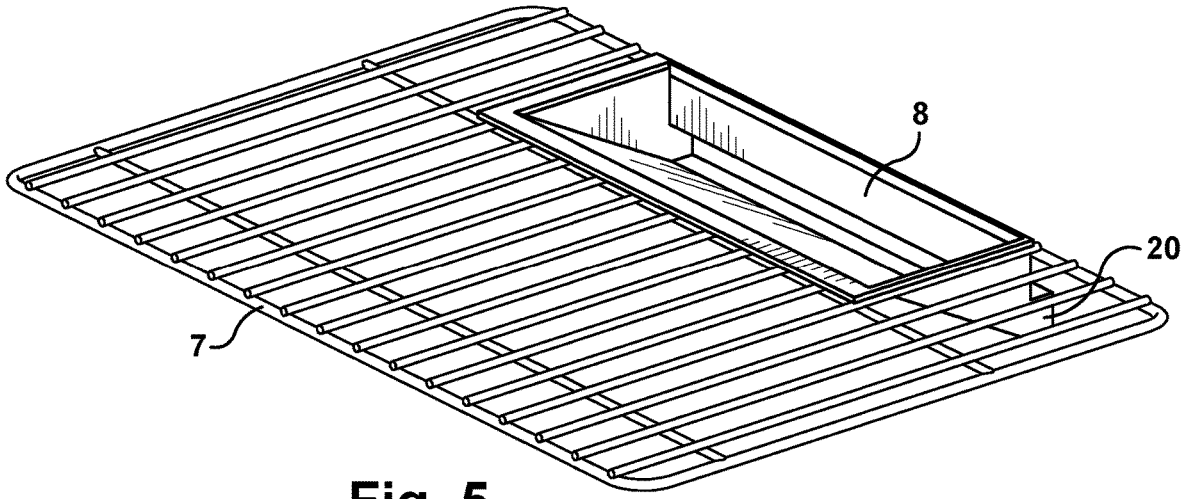
Figure 6:
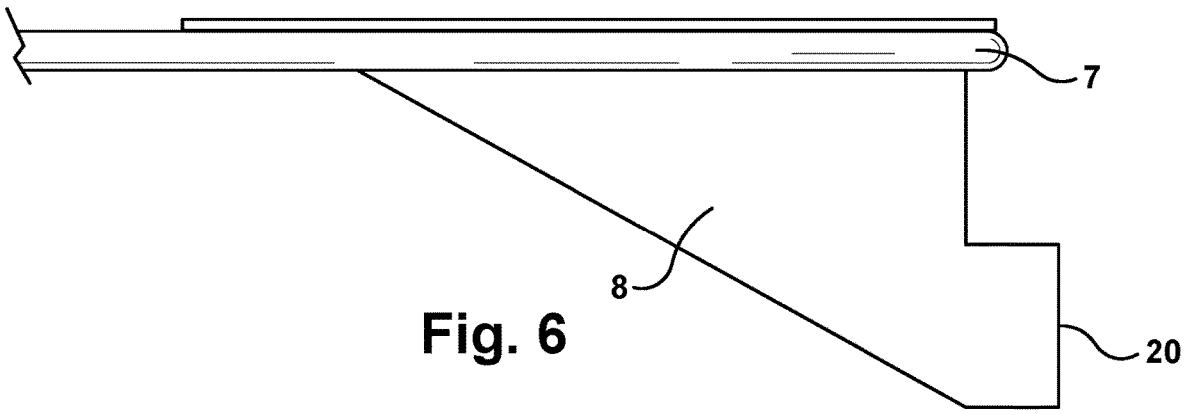
FIG. 6 is a side view of the water reservoir of the embodiment shown in FIGS. 4-5.

A preferred embodiment is shown in FIGS. 1-3. FIG. 1 shows a cooking oven 1 having a cooking cavity 2 accessible by an oven door 3. A steam generation system is provided, including water reservoir 8, water-reservoir lid 6, and a reservoir rack 7. As seen in FIG. 2, the reservoir rack 7 is comparable to a conventional oven rack but for a reservoir-receiving space 12 disposed at the rear of the rack. In the illustrated embodiment the receiving space 12 extends partially outside the general rectangular shape of the reservoir rack 7, such that in the cooking position of the reservoir rack 7 the water reservoir 8 in the receiving space 12 will extend a distance rearward, behind the rear edge of the rack 7. The reservoir rack 7 fits and can be supported on conventional oven rack guides 5, and can slide into and out of the cooking cavity 2. When the water reservoir 8 is in the reservoir-receiving space 12 of the reservoir rack 7 in the cooking position (as shown in FIG. 1), the reservoir 8 sits above thermal block 11 of a heater 19 such that the bottom surface of the reservoir 8 is in intimate contact with the upper surface of the thermal block 11. As seen in FIG. 3, embedded in the thermal block 11 is heating element 17 in the form of a resistance heater, which in use is connected to a power source via heating element connectors 9. Thus, the heating element 17 can generate thermal energy, which is transferred to the thermal block 11 and then into the water reservoir 8 in contact therewith. Liquid water in the water reservoir 8 can be converted to steam via this thermal energy. The heating element 17 can be wired in series with a thermal cut-off switch 10 via thermal bridge 18. The thermal bridge 18 constitutes a thermally conductive connection with the thermal block in order to transmit thermal energy therefrom to the cut-off switch 10. The thermal cut-off switch 10 is configured as a conventional bimetal switch effective to open the electric circuit that delivers power to the heating element 17 when a threshold temperature is reached. Upon cooling below a second threshold temperature, the cut-off switch 10 closes, thus restoring the power circuit. The cut-off temperature threshold is selected to ensure the thermal block does not heat up sufficiently to damage the appliance or produce undesirable risks. Alternatively, the cut-off switch 10 can be replaced with a relay in communication with a controller that will open and close the relay to remove and restore the power circuit based on temperature signals from a temperature sensor associated with the thermal block (not shown). When the temperature measured by the temperature sensor goes above a threshold value, the relay is opened.

In the embodiment of FIG. 1, the heating element connectors 9 and the thermal cut-off switch 10 are outside of the cooking cavity 2 at the rear of the cooking oven 1. In this embodiment heating element 17 and the thermal bridge 18 extend through openings in the rear wall of the cooking cavity 2. These openings are sealed to thermally insulate the cooking cavity and prevent fluids from passing through.

Returning to FIG. 2, the water reservoir 8 has outer flanges 13 adhered or formed with outer side walls of the reservoir 8, which engage the perimeter of the reservoir-receiving space 12 to support the reservoir in that space 12. The water-reservoir lid 6, which is supported by inner flanges 14 of the water reservoir 8, has steam openings 15 to permit steam to escape from the reservoir 8, and water fill ports 16 to fill reservoir 8 with liquid water. Steam produced in the reservoir 8 escapes via the steam openings 15 in the lid 6 and is delivered into the cooking cavity, where it can be circulated by convection fan 4.

Figure 7:
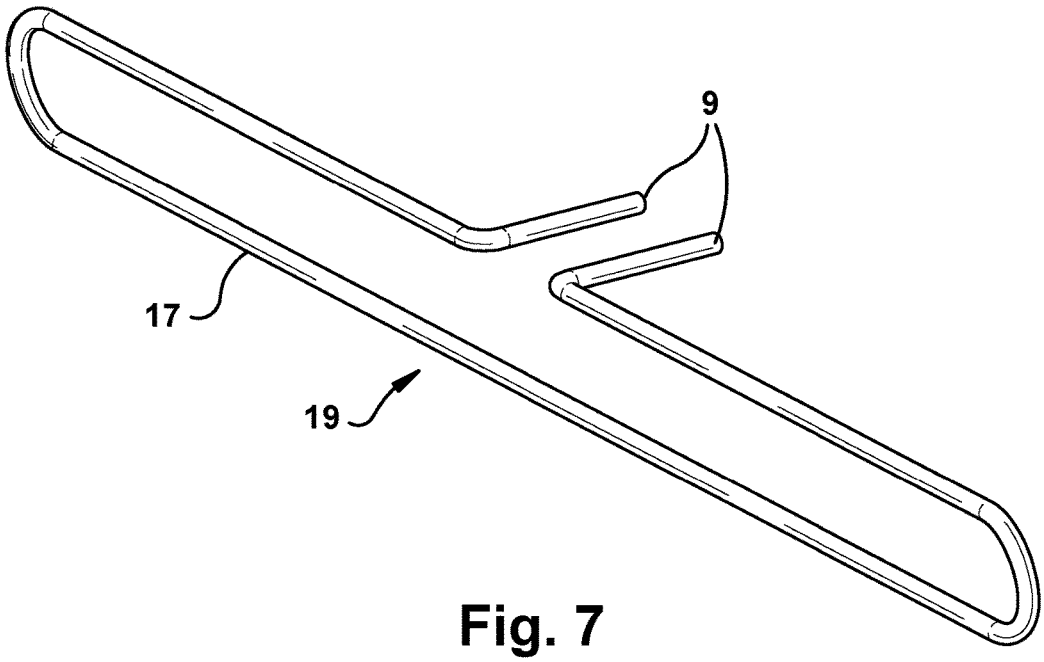
FIG. 7 illustrates an example heating element for heating the water reservoir according to disclosed embodiments.
Figure 8:
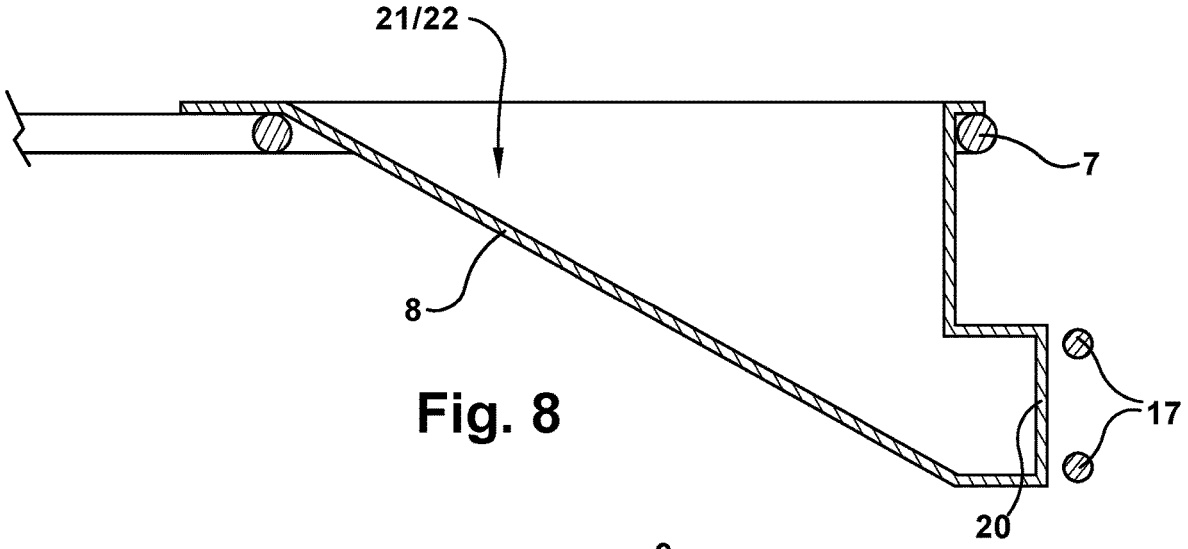
FIG. 8 is a side cross-section view showing the water reservoir of the embodiment shown in FIGS. 4-6 interacting with the heating element of FIG. 7 to deliver thermal energy to water within the reservoir.

Another embodiment is shown in FIGS. 4-8. In this embodiment the water reservoir 8 has a general triangular cross-section, having a rearward-extending thermal contact section 20 and a sloped section 22 that also serves as a water pouring section 21 (see FIG. 8). Unlike the earlier-described embodiment, the reservoir 8 in these figures itself extends rearward of the reservoir rack 7, in order to present a thermal contact section 20 rearward of the oven rack that can be readily contacted by a thermal block in the oven cavity. In this embodiment, the receiving space 12 in the reservoir rack 7 does not extend rearward of the general rectangular shape of the rack 7. As seen in FIG. 7-8, a heater (e.g. heating element 17 in the disclosed embodiment) shaped and positioned to intimately contact a rear wall of the thermal contact section 20 is provided at the rear of the oven cavity. When the rack 7 is fully inserted in the cooking position, the thermal contact section 20 of the water reservoir 8 is moved into position in contact with the heating element 17 (or alternatively with a thermal block containing such an element). When adding water to the water reservoir 8, the water is guided by the slopped section 22 to the thermal contact section 20 such that steam can be produced by a heater as described herein.

Figure 9:
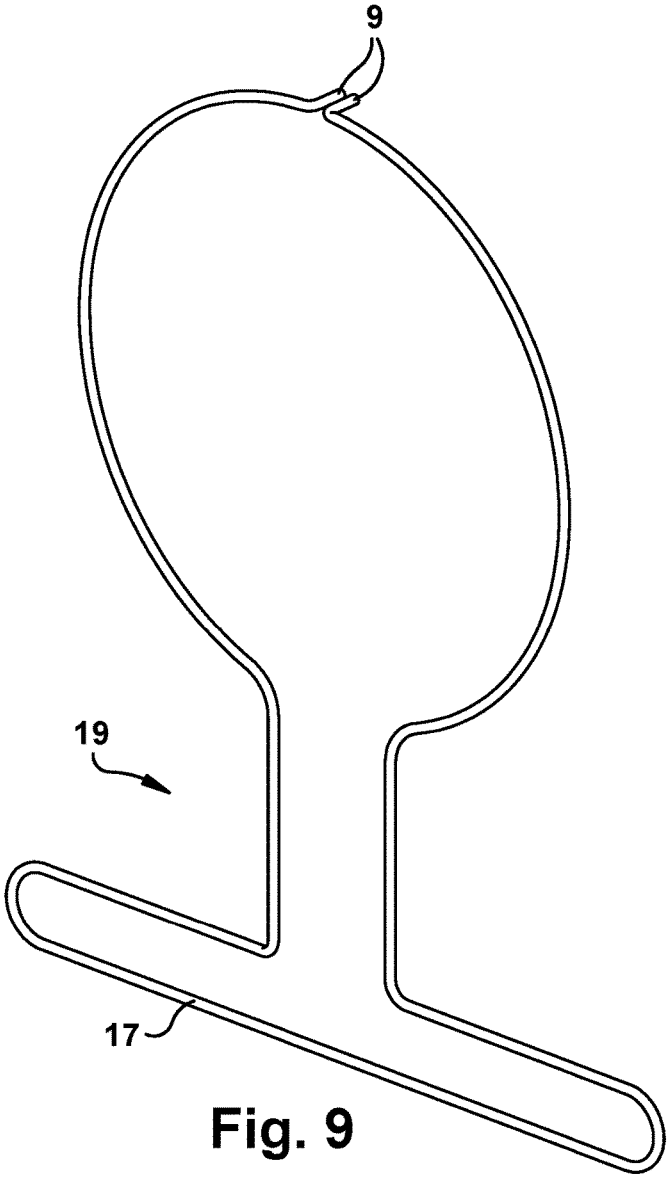
FIG. 9 illustrates another example heating element for heating the water reservoir according to disclosed embodiments.

As seen in FIG. 9 the heating element 17 can be shaped such that it extends extend to the proximity of a convection fan for providing thermal energy during a convection-cooking function, as well as have a portion that mates with a thermal contact section of a water reservoir according to the foregoing embodiment. In this manner, the same heating element can serve dual functions, and can also help to maintain steam in the cooking cavity in the gas phase by introducing thermal energy thereto as it is circulated by the convection fan 4.

Figure 10:
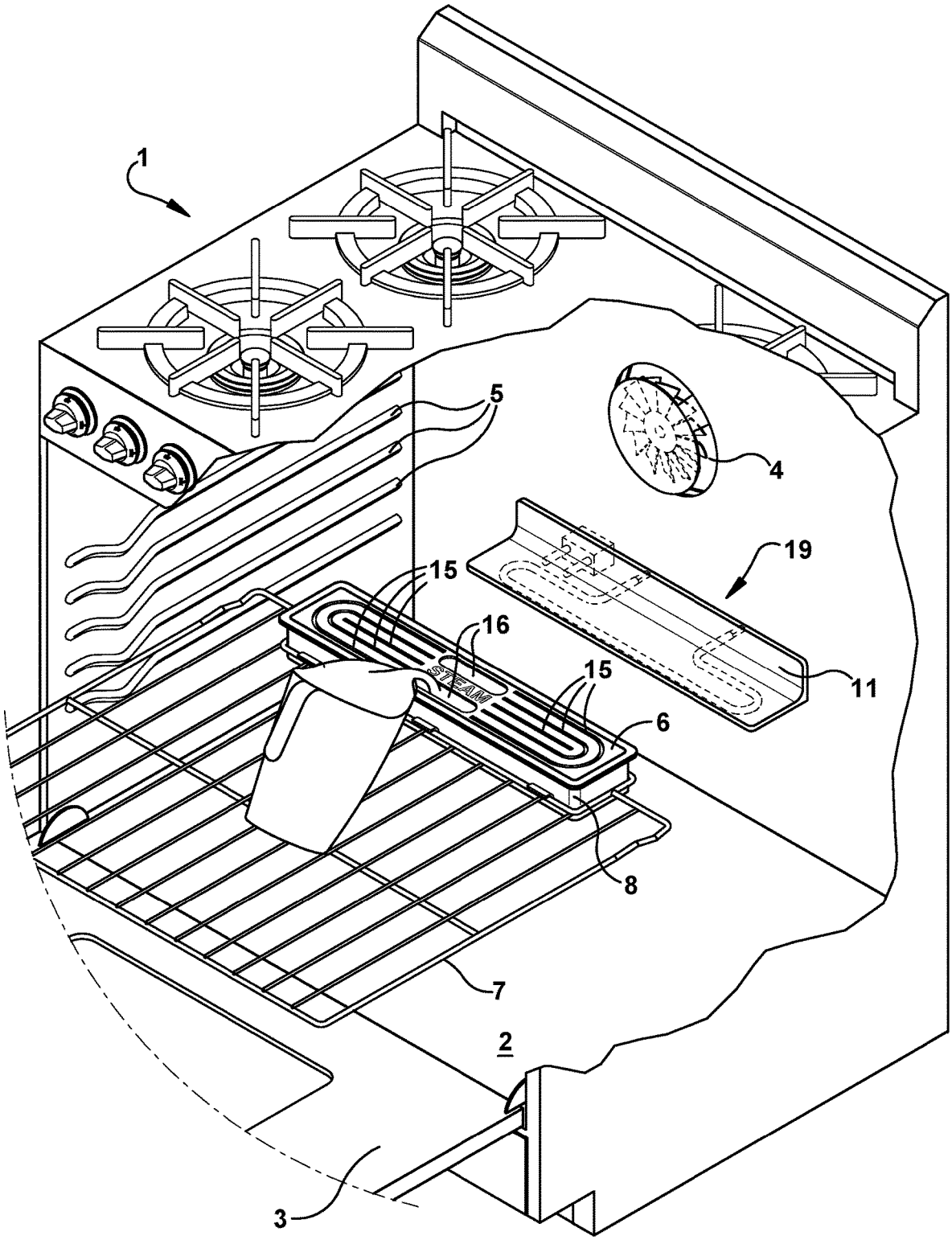
FIG. 10 is a schematic cross-section of an oven having the steam generation system showing the water reservoir being refilled in a first position within the oven cavity.
Figure 11:
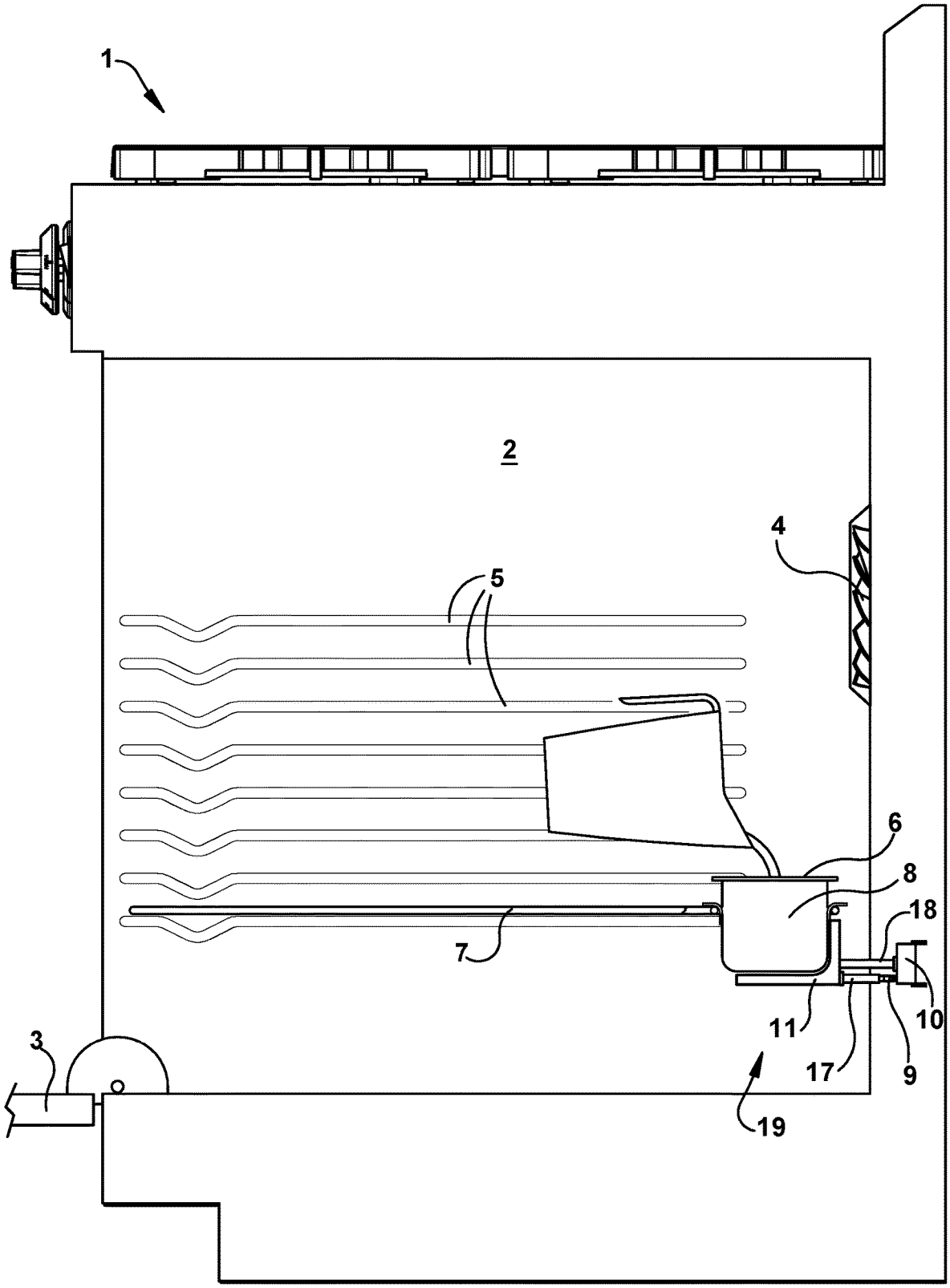
FIG. 11 is a schematic cross-section as in FIG. 10, showing the water reservoir being refilled in a second position within the oven cavity.
Figure 12:
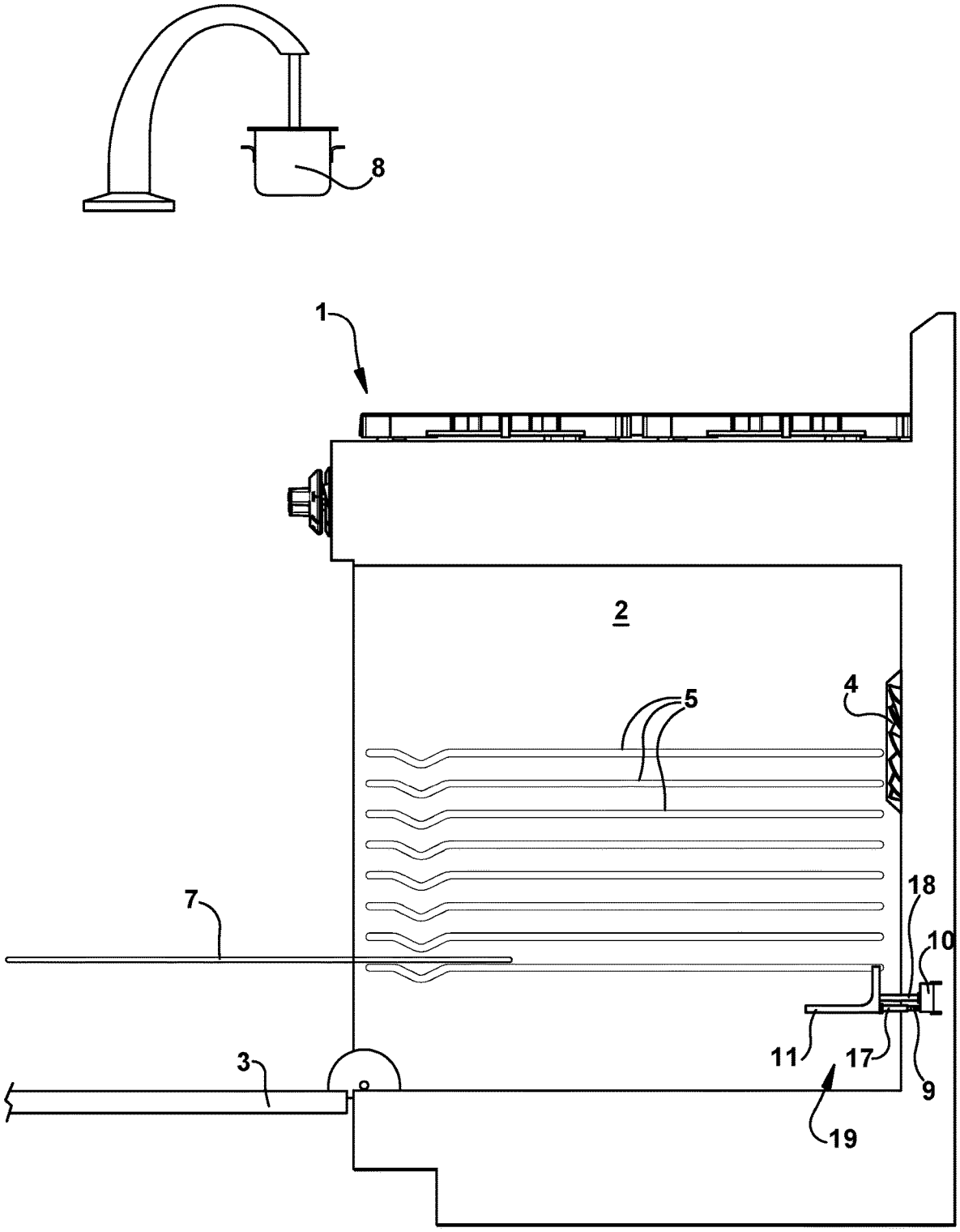
FIG. 12 is a schematic cross-section as in FIG. 10, showing the water reservoir being refilled outside the oven cavity.

The water reservoir 8 can be filled in the multiple ways. For example, as seen in FIG. 10, in a first position, namely the cooking position, the water reservoir 8 can be filled through the water filling port 16 by a user reaching into the oven cavity with a pitcher. As seen in FIG. 11, in a second position, namely the loading position, the water reservoir 8 can be filled through the water filling port 16 by a user reaching into the oven cavity with a pitcher. As seen in FIG. 12, in a third position, the water reservoir 8 can be removed from the reservoir rack and filled at a faucet.

Figure 13:
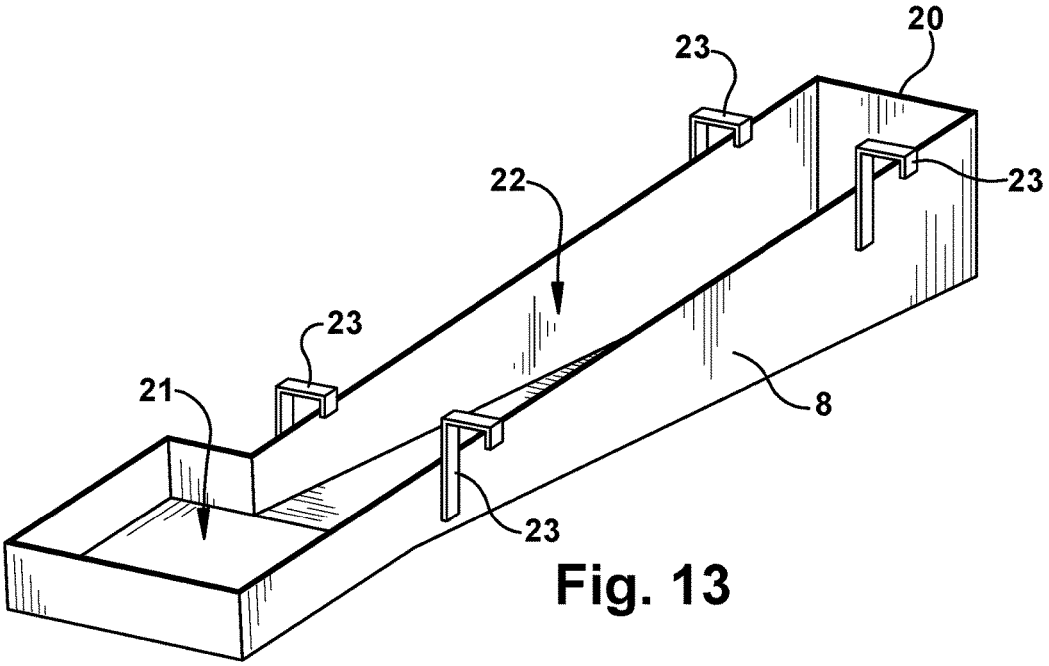
FIG. 13 is a front perspective view of a water reservoir with hooks for suspending the water reservoir from an oven rack according to a further embodiment.
Figure 14:
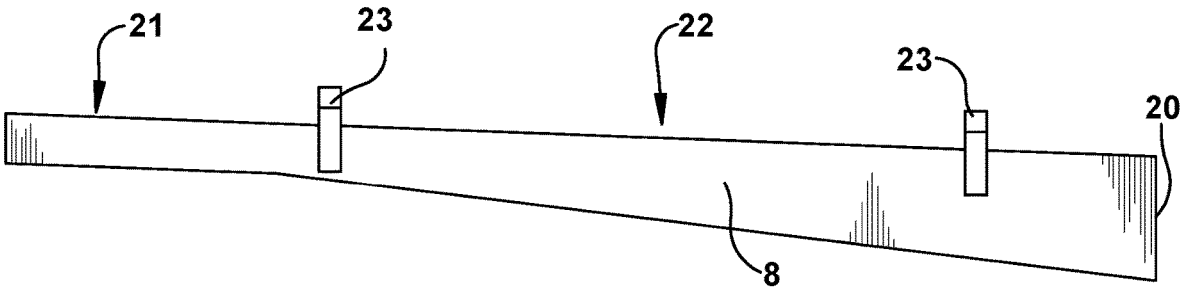
FIG. 14 is a side view of the water reservoir in FIG. 13.

Another embodiment of a water reservoir 8 is shown in FIGS. 13-14. In this embodiment the water reservoir 8 has a square-shaped water pouring section 21 at a front end thereof, connected to a thermal contact section 20 at the opposite, rear end by an intermediate sloped section 22. The sloped section 22 guides water from the water pouring section 21 to the thermal contact section 20 via gravity. Hooks 23 can engage bars or wires of an oven rack such that the reservoir is suspended below the rack. When the reservoir 8 is suspended from an oven rack, the water pouring section 21 is near the front of the oven rack and thus near an oven door such that water can be easily poured into the water reservoir 8. Furthermore, the thermal contact section 20 is near the rear of the oven rack so that it can engage a heater for producing steam as described herein. When water is poured into the water pouring section 21, it proceeds to the sloped section 22 and is conducted to the thermal contact section 20 so that steam can be produced.

Illustrative embodiments have been described, hereinabove. It will be apparent to those skilled in the art that the above apparatuses and methods may incorporate changes and modifications without departing from the scope of this disclosure. The invention is therefore not limited to particular details of this disclosure, and covers such modifications thereto as come within the spirit and the scope of the claims.

What is claimed is:

1. A cooking oven comprising a cooking cavity and a steam generation system, the steam generation system comprising:

a heater fixed within the cooking cavity;

a reservoir rack configured to be inserted into the cooking cavity to a cooking position and withdrawn from the cooking position within the cooking cavity; and a water reservoir configured to be supported by said reservoir rack for insertion and removal from the cooking cavity so that said water reservoir is in conductive thermal communication with the heater when the water reservoir is supported by said reservoir rack and said reservoir rack is in said cooking position within the cooking cavity, and is not in conductive thermal communication with the heater when said reservoir rack, supporting the reservoir therein, is withdrawn from said cooking position in the cooking cavity.

2. The cooking oven according to claim 1, said reservoir rack comprising a reservoir-receiving space configured to receive and support the water reservoir.

3. The cooking oven according to claim 2, the reservoir rack comprising a cooking grid that can support a food item to be cooked while the water reservoir is received in the reservoir-receiving space.

4. The cooking oven according to claim 2, the reservoir-receiving space being at a rear of the reservoir rack, and being effective to constrain movement of said water reservoir in at least five directions when received in said reservoir-receiving space.

5. The cooking oven according to claim 1, the reservoir rack being movable between said cooking position wherein the reservoir rack is fully inserted into the cooking cavity, and a loading position wherein the reservoir rack is at least partially withdrawn from the cooking cavity.

6. The cooking oven according to claim 1, the heater comprising a thermal block comprising a thermally conductive material in thermal communication with a resistance heating element.

7. The cooking oven according to claim 6, the resistance heating element being embedded in said thermal block.

8. The cooking oven according to claim 6, arranged such that an upper surface of the thermal block contacts a bottom surface of the water reservoir to establish said conductive thermal communication.

9. The cooking oven according to claim 1, the heater comprising a resistance heating element arranged to contact an outer surface of the water reservoir to establish said conductive thermal communication.

10. The cooking oven according to claim 9, said resistance heating element being arranged to contact a rearward-extending thermal-contact portion of said water reservoir to establish said conductive thermal communication.

11. The cooking oven according to claim 1, the heater being fixed to a rear wall of the cooking cavity.

12. The cooking oven according to claim 6, the thermal block being fixed to a rear wall of the cooking cavity.

13. The cooking oven according to claim 10, the resistance heating element being fixed to a rear wall of the cooking cavity.

14. The cooking oven according to claim 1, the heater comprising an electric heating element connected to a power source and wired in series with a thermal cut-off switch.

15. The cooking oven according to claim 14, the thermal cut-off switch being in thermal communication with the heater via a conductive thermal bridge.

16. The cooking oven according to claim 1, the steam generation system further comprising a reservoir lid to close an opening of the reservoir, the reservoir lid comprising steam openings that allow steam to pass.

17. The cooking oven according to claim 16, the reservoir lid further comprising a water filling port that allows the water reservoir to be filled with water without removing the reservoir lid.

18. The cooking oven according to claim 1, the water reservoir comprising hooks configured to suspend the water reservoir below the reservoir rack, said water reservoir further comprising a water pouring section at a front end thereof, a thermal contact section at a rear end thereof, and an intermediate sloped section to guide water introduced in the pouring section toward the thermal contact section.

* * * * *